US007281986B2

(12) United States Patent
Tolson

(10) Patent No.: US 7,281,986 B2
(45) Date of Patent: Oct. 16, 2007

(54) PARALLEL PUTTING DEVICE AND METHOD

(76) Inventor: Mark W. Tolson, 1604 Pinhook Rd. Suite 151, Lafayette, LA (US) 70508

( * ) Notice: Subject to any disclaimer, the term of this patent is extended or adjusted under 35 U.S.C. 154(b) by 274 days.

(21) Appl. No.: 11/060,695

(22) Filed: Feb. 17, 2005

(65) Prior Publication Data

US 2006/0183565 A1 Aug. 17, 2006

(51) Int. Cl.
*A63B 69/36* (2006.01)

(52) U.S. Cl. ..... 473/257; 473/261; 473/258

(58) Field of Classification Search ..... 473/218–220, 473/257–261, 264–272
See application file for complete search history.

(56) References Cited

U.S. PATENT DOCUMENTS

| | | | | |
|---|---|---|---|---|
| 4,129,301 | A | 12/1978 | Kenney | |
| 5,037,100 | A | 8/1991 | Montgomery, Sr. | |
| 5,332,211 | A | 7/1994 | Rife et al. | |
| 5,503,395 | A * | 4/1996 | Cook | 473/261 |
| 5,586,945 | A | 12/1996 | Vonderhaar | |
| 5,769,732 | A | 6/1998 | O'Neal | |
| D410,721 | S | 6/1999 | Trapp et al. | |
| 6,048,273 | A | 4/2000 | Clement | |
| 6,129,639 | A * | 10/2000 | Brock et al. | 473/260 |
| 6,572,486 | B2 | 6/2003 | Sweinhart | |
| 6,755,784 | B2 | 6/2004 | Williams et al. | |
| 2002/0111224 | A1 | 8/2002 | Seinhart | |
| 2002/0173370 | A1 | 11/2002 | Chapman | |
| 2003/0199330 | A1 | 10/2003 | Magallanes | |

* cited by examiner

*Primary Examiner*—Nini F. Legesse
(74) *Attorney, Agent, or Firm*—C. Dean Domingue; Robert L. Waddell; Ted M. Anthony

(57) ABSTRACT

A device for putting a golf ball. In one embodiment, the device comprises a base having an elongated side defining a base line, a first and second shoulder attached to the base, and a guide member pivotly attached to the first and second shoulders. The guide member has a top surface, and the guide member contains an elongated side defining a shaft line that is parallel with the base line of the base. The top surface also has a slotted opening that defines a practice line that is parallel with the base line of the base and the shaft line of the guide member. In one embodiment, the slotted opening has a variable top. Also, the device may include a laser and a target reflector, and wherein the laser beam is parallel with the base line, shaft line, and practice line.

16 Claims, 6 Drawing Sheets

PARALLEL PUTTING DEVICE AND METHOD

BACKGROUND OF THE INVENTION

This invention relates to a putting device. More specifically, but not by way of limitation, this invention relates to a putting device and method that teaches the user to stroke a shaft of a putter along a parallel line.

Golf is a game played and enjoyed by millions over the world. The history of the game dates back hundreds of years. A crucial aspect of the game is that of putting the golf ball on the green. Despite the rather innocent-looking appearance, putting is a very difficult skill to acquire. Numerous techniques as well as teaching devices have been devised over the years in order to help golfers in their putting game.

Golfers spend thousands of dollars over their golfing careers in an effort to improve their putting stroke. In spite of the time and money spent, there is no device that instills the importance and discipline of keeping the putter shaft parallel to the target line. Additionally, there is a need for a device that teaches the golfer the proper technique without the need of having an individual instructor present. These, as well as many other needs, will be met by the following disclosed invention.

SUMMARY OF THE INVENTION

An apparatus for putting a golf ball is disclosed. The apparatus comprises a base having an elongated side defining a base line. The apparatus further comprises a guide member having a first side attached to a first end of the base, a second side attached to a second end of the base, and a top surface. In one preferred embodiment, the guide member contains an elongated side defining a shaft line that is parallel with the base line of the base, and the top surface has a slotted opening that defines a practice line that is parallel with the base line of the base and the shaft line of the guide member.

The apparatus may further comprise a first shoulder attached to a first end of the base, a second shoulder attached to a second end of the base, and wherein the first side of the guide member is pivotly attached to the first shoulder, and the second side of the guide member is pivotly attached to the second shoulder.

The apparatus may further comprise a laser means, operatively associated with the first end of the base, for generating a laser beam, and a target reflector for the laser beam to illuminate. The laser beam is parallel with the base line, shaft line, and practice line.

In one preferred embodiment, the target reflector is a golf ball. In one preferred embodiment, a removable laser alignment means for positioning a laser may be included. The laser is operatively attached to the laser alignment means, and a target reflector for the laser beam to illuminate is included. In this most preferred embodiment, the laser beam is parallel with the base line, shaft line, and practice line. Additionally, the laser alignment means may comprise a telescoping arm having a laser housing so that the laser housing can be telescoped from a retracted position to an extended position.

In one preferred embodiment, the slotted opening is sized to receive a shaft of a putter. Also, the slotted opening may contain an enlarged end section. The slotted opening may contain a sleeve for the variable opening.

A method for putting a golf ball into a golf ball hole is also disclosed. The method comprises providing a putting device, wherein the putting device comprises: a base having an elongated side defining a base line; a first and second shoulder pivotly attached to the base; a guide member having a first side attached to the first shoulder and a second side attached to the second shoulder; and, wherein the guide member contains an elongated side defining a shaft line that is parallel with the base line of the base; and, wherein a top surface of the guide member has a slot that defines a practice line that is parallel with the base line of the base and the shaft line of the guide member.

The method further includes placing a shaft of a putter on the shaft line of the guide member, stroking the putter while keeping the shaft of the putter on the shaft line of the guide member, and striking the golf ball. Additionally, the step of placing the shaft on the shaft line of the guide member may include adjusting the angle of the guide member by pivoting the guide member at the first shoulder and the second shoulder.

In one preferred embodiment, the putting device further comprises a laser means for generating a laser beam, and the step of placing the golf ball before the base includes generating the laser beam on a target line, wherein the target line is parallel to the base line, and reflecting the laser beam off of a reflector placed in line with the target line and down stream of the hole.

In another preferred embodiment, the method includes placing the shaft within the slot, and the method further includes stroking the putter while the shaft is kept on the practice line of the guide member, and striking the golf ball.

An advantage of the present invention is to teach, reinforce, and test a golfer with respect to keeping the putter shaft, and more specifically, a small area on the putter shaft, parallel to the target line. Another advantage is that the same device can be used with students of various heights. Yet another advantage is that the device may also include a laser means for ease of setup and use. Still yet another advantage is that the device is easy to install. Another advantage is that the device is economical to manufacture. Another advantage is that the device allows each individual golfer to use his or her individual putter shaft angle at address. The device can be used by both right-handed and left-handed players.

Yet another advantage is that the device allows each person to test different setups, i.e., shaft angle, stance, posture, etc., for consistent putting results. The parallel guide gives the golfer the feel needed to imprint a sound putting stroke from setup to back stroke and forward stroke. Another advantage is that the device gives one immediate feedback. The device can be used at home or on a putting green.

A feature of the present invention is that the pivoting guide member allows for easy adjustment to the user's height. Also, the pivoting guide member allows adjustment to suit different putting styles. Another feature is that the device will work on straight putts as well as putts that break.

Another feature is that the laser means can be used to aid in setting up the device as well as visualizing the putt. Another feature is that the laser allows proper alignment and gives the user immediate feedback since the laser dot from the laser can be seen on the golf ball all the way into the golf ball hole on straight putts. Yet another feature is that the slotted top portion allows the user to place the shaft of the putter within a defined self-correcting area. Still yet another feature is that the user can remove the shaft of the putter from the defined self-correcting area and place the shaft on the elongated side of the guide member for movement along the shaft line.

DETAILED DESCRIPTION OF THE PREFERRED EMBODIMENTS

Figure 1:
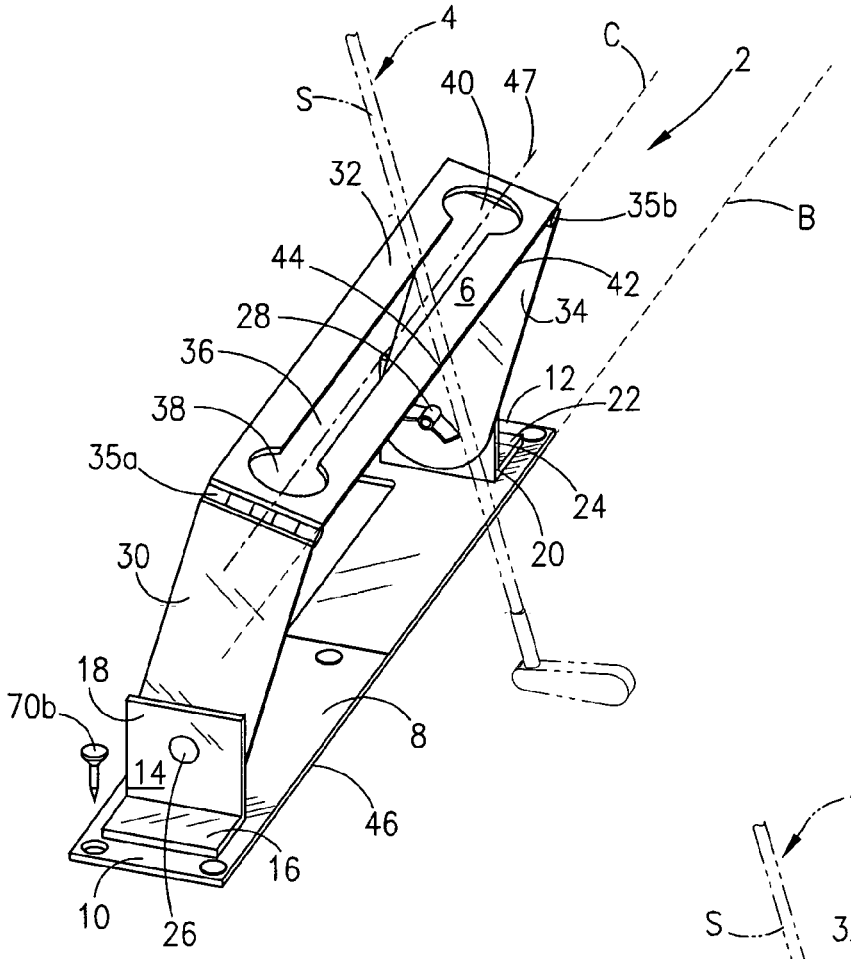
FIG. 1 is an isometric view of a preferred embodiment of the putting training device with the putter resting on the guide member.

Referring now to FIG. 1, an isometric view of a preferred embodiment of the putting training device 2 with the putter 4 resting on the guide member 6 is shown. More specifically, the putting training device 2 comprises a base 8 that has a first end 10 and a second end 12. A first shoulder 14 is included, and wherein the first shoulder 14 contains a horizontal leg 16 that extends to a vertical leg 18, and wherein the leg 16 is attached to the first end 10 via conventional means such as nuts and bolts, or gluing. The second shoulder 20 has a horizontal leg 22 that extends to a vertical leg 24, and wherein the second shoulder 20 is also attached to the base 8 in a similar manner.

The guide member 6 will be pivotly attached to the shoulders 14, 20 at the pivot point 26 and 28, which in one embodiment is simply a screw with wing nut. The guide member 6 consists of a first leg 30 that extends to a slotted top portion 32, which in turn extends to the second leg 34. First leg 30 may be attached to top portion 32 via a hinge 35*a* and top portion 32 may be attached to second leg 34 via a hinge 35*b*; with the hinged attachment, the training device 2 can be disassembled and folded up for transporting the entire training device 2. The first leg 30 is pivotly attached to the leg 18, and the second leg 34 is pivotly attached to the leg 24. The slotted top portion 32 contains an elongated slot opening 36 that defines an area that the putter shaft may travel, and wherein the slot 36 contains enlarged openings 38, 40. The slotted top portion 32 contains the edge guide 42 which defines a shaft line C; as seen in FIG. 1, the shaft S of the putter 4 rests on the edge guide 42 at the point 44. The edge guide 42 is parallel with the edge 46 of the base 8, and the edge 46 defines base line B. The centerline of the slot opening 36 defines the practice line 47. FIG. 1 also depicts the anchor tee 70*b*.

Figure 2:
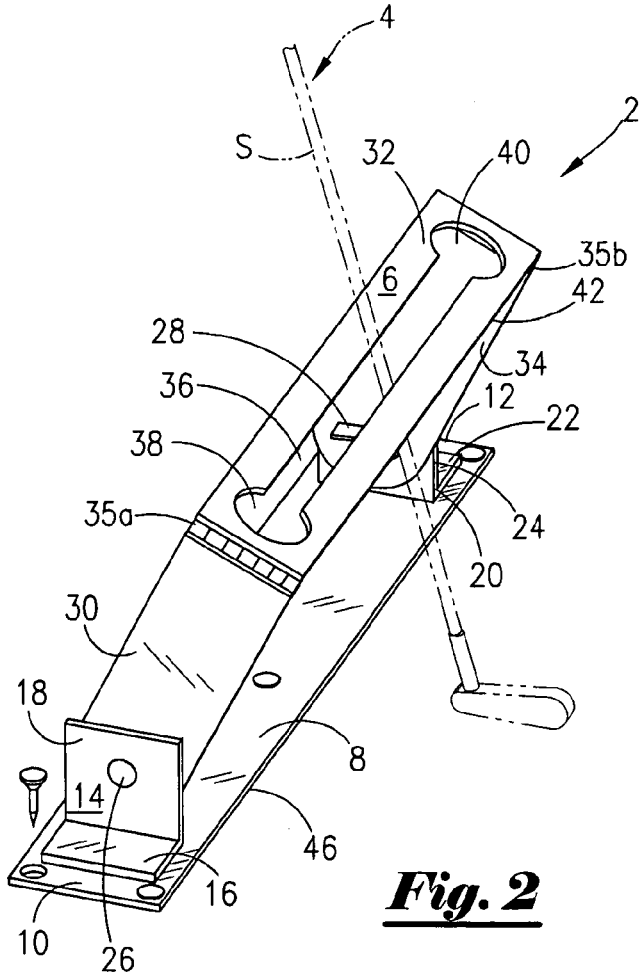
FIG. 2 is an isometric view of the putting training device seen in FIG. 1 with the putter within the slot.

Referring now to FIG. 2, the putting training device 2 seen in FIG. 1 is shown and wherein the shaft S of the putter 4 is captured within the restricted area of the slot 36. In this way, the shaft of the putter 4 will be held within the predefined area that is defined by the slot 36. It should be noted that like numbers refer to like components in the various figures. In one preferred embodiment, it is possible to have a variable sized slot opening so that the width of the slot opening can be increased or decreased according to the desire of the user, as will be more fully explained later in the application.

Figure 3:
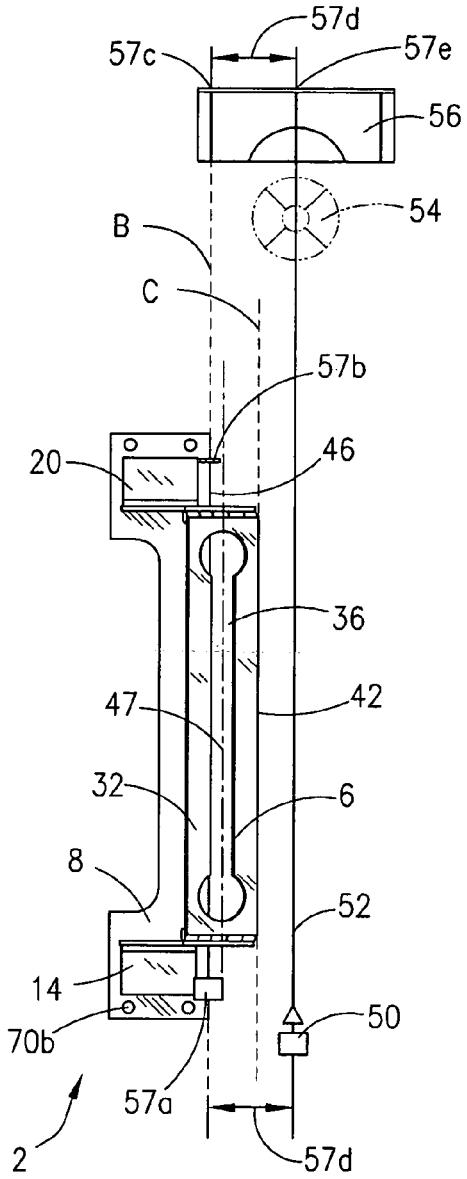
FIG. 3 is a top view of a second embodiment of the putting training device seen in FIG. 1 with laser alignment means.

FIG. 3 is a top view of a second embodiment of the putting training device 2, seen in FIG. 1, with a laser means 50. The edge guide 42 of the guide member 6 defines the shaft line (denoted by the line C) that is parallel with the base 8 (denoted by the line B) defined by the edge 46. The laser means 50 generates a laser beam 52 (also referred to as the target line). Lasers are commercially available from Radio Shack Inc. under the name Laser Pointer. In accordance with the teachings of the present invention, the laser means 50 will be lined up with a golf ball hole 54. The user will place a reflector 56 on the far side of the hole; please note that the reflector can also be a golf ball. As seen in FIG. 3, the reflector 56 is a plate structure, in one preferred embodiment.

The embodiment of FIG. 3 further shows the laser housing 57*a* (that can temporarily contain and hold the laser means 50) and the fork device 57*b*. The laser housing 57*a* is configured to receive the laser means 50. The fork device 57*b* is a prong type of device shaped similar to a gun-sight. The reflector 56 is centered downstream of the golf ball hole and set. As shown in FIG. 3, the laser housing 57*a* is situated in line with the edge 46 and the base line B. Therefore, when the laser means generates a laser beam, the laser beam will be parallel to the edge 46 and base line B. Moreover, the laser beam will be aimed through the fork device 57*b* to hit the reflector 56 at point 57*c*. The laser means 50 can be moved from housing 57*a* to the position in front of the edge 46, as shown in FIG. 3. In one preferred embodiment, the distance from edge 46 to the position of the laser means 50 shown in FIG. 3 is approximately 4" (denoted by the numeral 57*d*). The distance from point 57*c* to the center of the reflector 56 is also 4" (the center of the reflector 56 is shown as point 57*e*).

Once the laser means 50 is placed in the position shown in FIG. 3, the laser beam 52 will be reflected onto the surface of the reflector 56 at point 57*e*. Hence, the laser beam 52 will be parallel with the edge 46 as well as the edge guide 42. Put another way, the target line 52, shaft line C, practice line 47, and base line B are all parallel.

Figure 4:
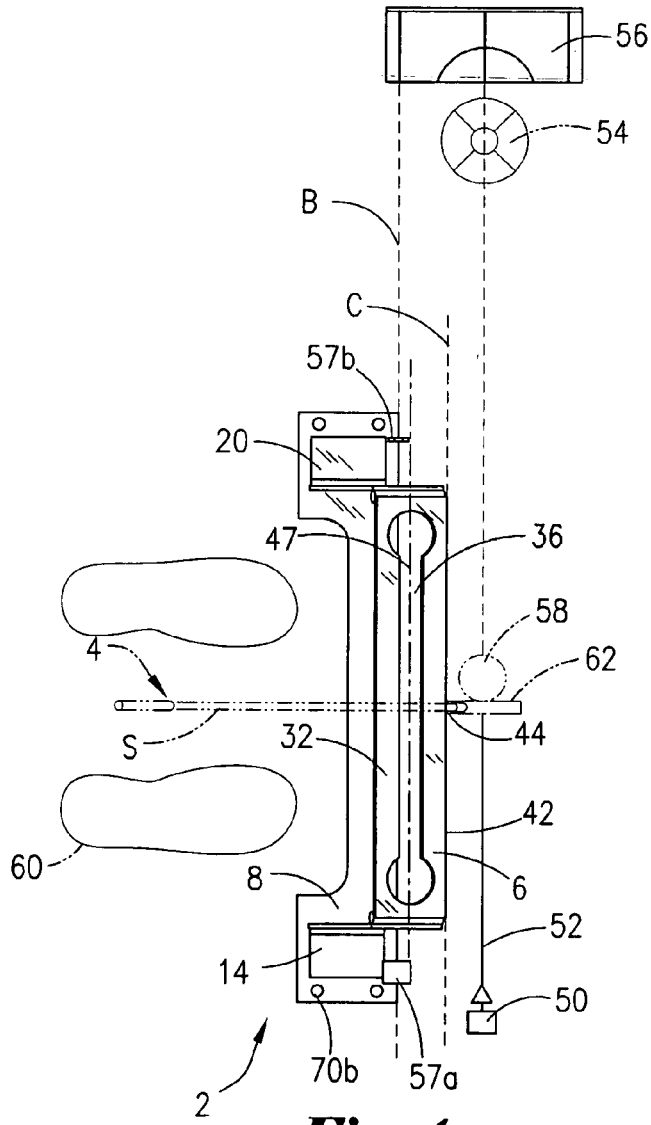
FIG. 4 is a top view of the putting training device and laser alignment means seen in FIG. 3 with the putter in contact with the edge guide.

FIG. 4 is a top view of the putting training device 2 and laser means 50 seen in FIG. 3 along with the putter 4. Hence, the user will address the golf ball 58, as shown by the footprints 60. The putter face 62 of the putter is perpendicular to the laser beam 52, base line B, as well as shaft line C. Also, the shaft S of the putter 4 will be in contact with the edge guide 42 at point 44. The user would then stroke the ball while keeping the shaft S along the edge guide 42.

Figure 5:
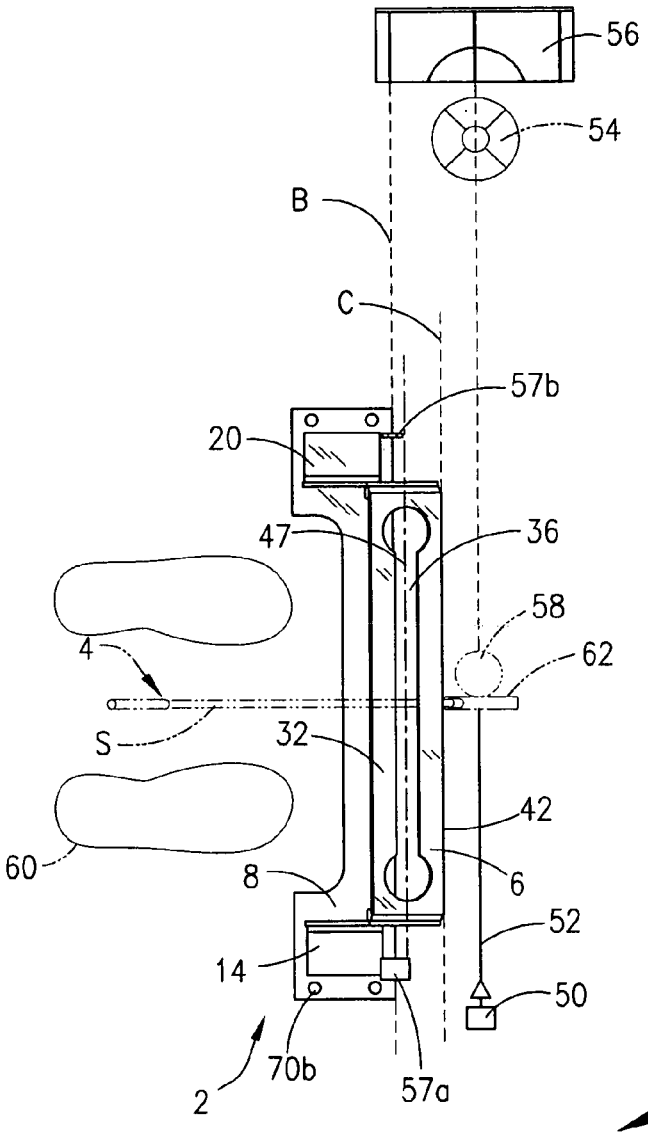
FIG. 5 is a top view of the putting training device seen in FIG. 4 with the putter within the slot.

Referring now to FIG. 5, a top view of the putting training device 2 seen in FIG. 4 with the putter 4 within the slot 36 will now be described. With this embodiment, the shaft S of the putter is kept within the area defined by the slot 36. As noted earlier, it is within the teachings of the present invention that the slot 36 may be of variable size so that the width of the slot opening can be varied to train the user in keeping the shaft of the putter within the predefined parallel area, as will be more fully explained later in the application.

In one preferred embodiment, the user should practice the putting stroke without hitting either side of the slot 36. If the user continually hits the sides of the slot 36, the user should go back to the original setup along the edge guide 42 to reinforce the proper parallel stroke. When the user is keeping the putter shaft in the training guide slot 36, the user can then reduce the training guide slot 36 width by adjusting the slot 36 incrementally as the user masters the proper parallel stroke.

Figure 6:
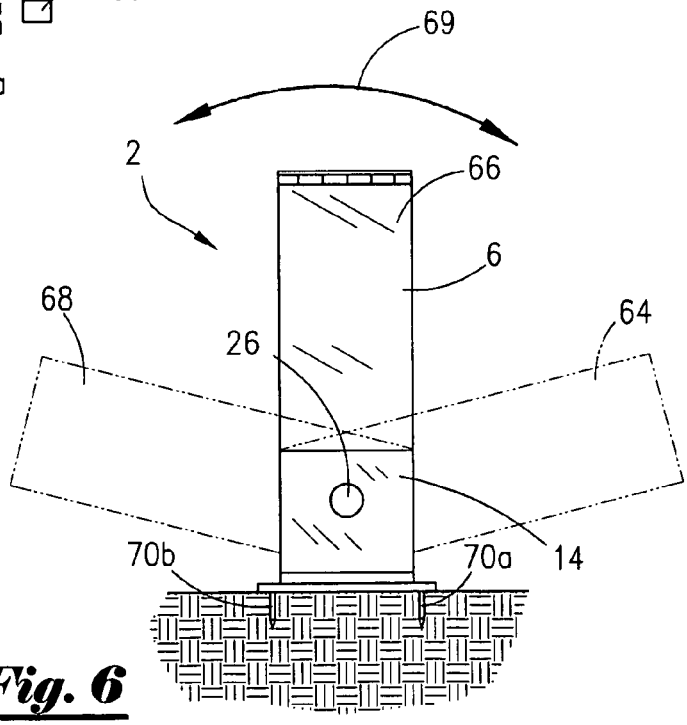
FIG. 6 is a side view of the putting training device seen in FIG. 1 pivoted in different angles.

FIG. 6 is a side view of the putting training device seen in FIG. 1 pivoted in different angles. According to the teachings of the present invention, the user can pivot the guide member 6 to an angle that suits his or her individual putting style. This is done by loosening the wing nuts and bolts, adjusting to the proper angle, and tightening the nuts and bolts back. The guide member 6 is shown pivoted at different angles. At the position denoted by the numeral 64, the guide member 6 is at 15 degrees relative to horizontal; at the position denoted by the numeral 66, the guide member 6 is at a 90 degree angle relative to horizontal; and, at the position denoted by the numeral 68, the guide member 6 is at a 165 degree angle relative to horizontal. The arrow 69 represents the angular movement. Note that the anchor tees 70*a*, 70*b* anchor base 8 to the ground.

Figure 7:
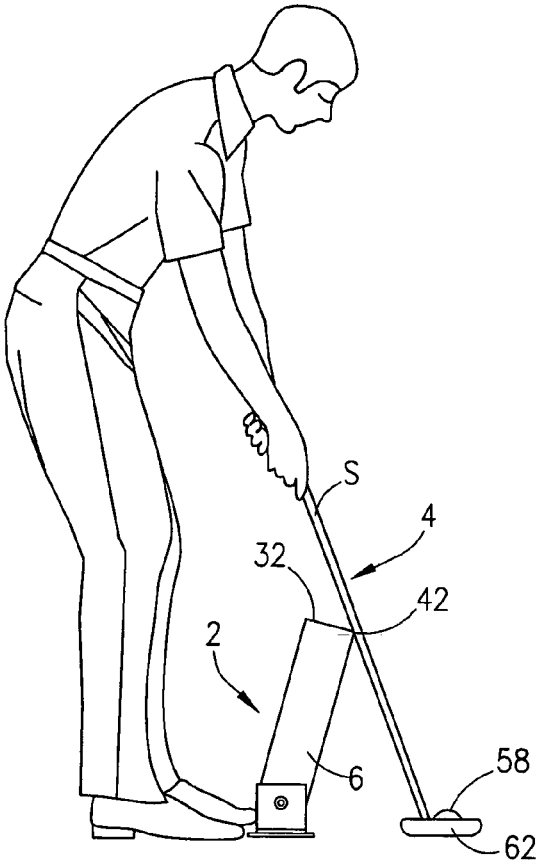
FIG. 7 is a perspective view of the putting training device with a golfer having the putter shaft disposed on the edge guide.
Figure 8:
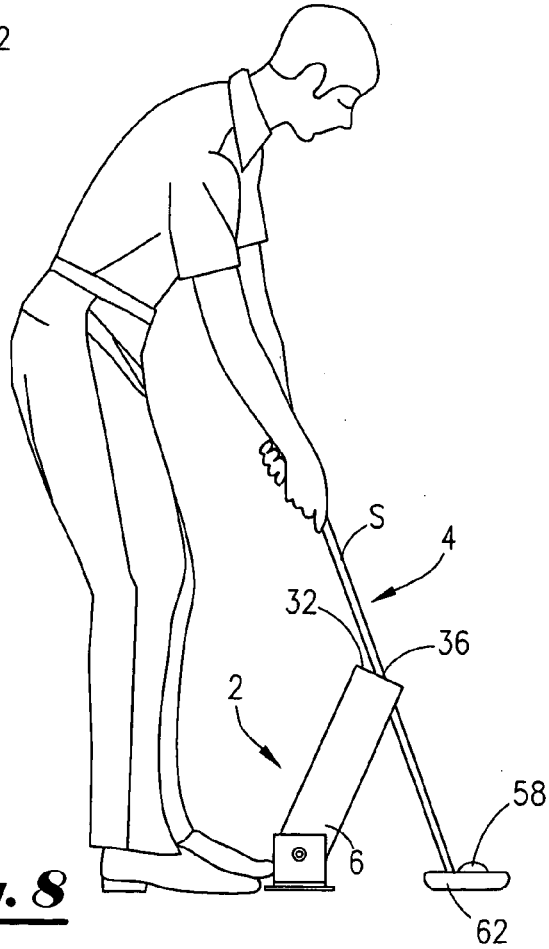
FIG. 8 is a perspective view of the putting training device with a golfer having the putter shaft disposed within the slot.

In FIG. 7, a perspective view of the putting training device 2 with a golfer having the putter shaft S disposed on the edge 42 of guide member 6 is illustrated. Note the tilt of the guide member 6 relative to the horizontal ground. Note that with some putters, the shaft S has steps of gradually increasing shaft diameters. Therefore, these steps could contact with the edge guide 42, and perhaps impede and/or interfere with the stroke. Hence, it is within the teachings of this invention to have a shaft sleeve concentrically disposed about the shaft area where the shaft comes into contact with the edge guide 42. FIG. 8 depicts the perspective view of the putting training device 2 with a golfer having the putter shaft S disposed within the slotted guide 36.

In operation, and referring generally to FIG. 3, the user would begin with a straight putt of approximately 9 feet. The user places the reflector 56 directly behind the target hole 54. The laser means 50 is placed within housing 57*a*, and the laser means 50 is turned on, and the beam is directed through the fork 57*b*. The entire putting training device 2 is adjusted so that the laser beam hits point 57*c*. The user will anchor the device 2. The user will then remove the laser means 50 and place the laser means 50 a distance from the base line B of 4 inches. At this point, the laser beam 52 is adjusted so that the laser beam strikes the center of the reflector 56 behind the target hole 54. The golfer can check to make sure that base edge 46, edge guide 42 and the laser beam 52 are all parallel. In other words, the base line B, shaft line C, practice line 47 and target line 52 should all be parallel.

The user can anchor the base with tees (denoted by the numerals 70*a*, 70*b* seen in FIG. 6) through apertures in the base 8 making sure that the laser beam stays in line. The target line 52, base line B, and the edge guide line C are parallel. Referring now to FIG. 4, the user places the putting ball 58 on the target line 52 so that the laser beam is in the center of the putting ball 58. The user would set up to the ball 58 in the user's normal putting stance. Remember that putting is individual and that there are many different setups. The user adjusts the parallel guide member 6 to the user's shaft angle. The user should again check to see if the base line B and shaft line C are still parallel.

The user should then tighten the wing nuts 28 to set the parallel guide member 6 to the user's exact shaft angle. The user will then readdress the ball 58 with the putter shaft slightly touching the edge 42. The putter face 62 should be square to the target beam 52. The user strokes the putt making sure the putter shaft S stays on the parallel guide member 6 and, in particular, on the edge 42, on both the back stroke and the forward stroke. Please note that in the most preferred embodiment, in the back stroke, the putter face 62 would open with the shaft staying on the shaft guide 42. As the golfer goes forward with the forward stroke, and at the point of the putter face 62 making contact with the golf ball 58, the putter is now square again with the golf ball 58 and the target line 52. As the forward stroke continues, the putter face 62 continues to close. Due to the contact of the shaft S to the edge 42 and the proximity of the user hands on the putter grip, the user feels the shaft S on the edge 42. It is much easier to concentrate strictly on the point where the putter shaft S touches the parallel guide member 6, and in this way, the user can feel this point on the edge 42 and concentrate on only a small area that needs to stay parallel to the target line.

In another embodiment, it is possible to use a chalk line to create a target line by simply popping a chalk line in place of the laser beam. It should also be noted that the laser can be a removable attachment to the base 8, as will be described later, or, alternatively, can be set off independently of the base as a stand-alone laser means, as seen in FIGS. 3, 4 and 5.

Figure 9:
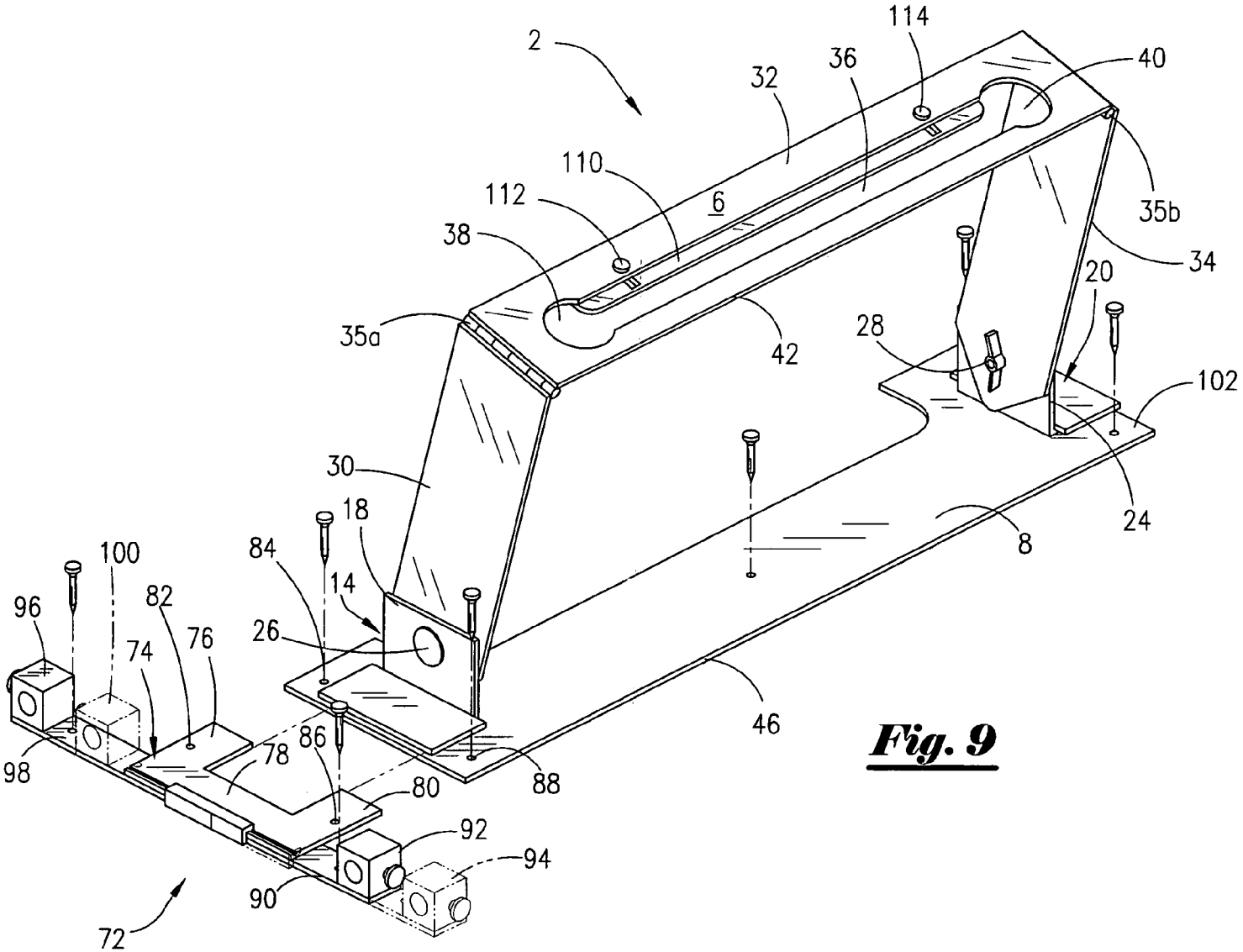
FIG. 9 is an exploded view of a second preferred embodiment of the putting training device with attached laser means.

In a second embodiment, which is the most preferred embodiment of this application, FIG. 9 illustrates a partially exploded view of a second preferred embodiment of the putting training device 2 with attached laser means. As noted earlier, like numbers appearing in the various figures refer to like components. This preferred embodiment includes the base 8 with the first end 10 and second end 12. The first shoulder 14 is included, and wherein the first shoulder 14 contains the horizontal leg 16 that extends to the vertical leg 18, and wherein the leg 16 is attached to the first end 10. The second shoulder 20 has the horizontal leg 22 that extends to the vertical leg 24, and wherein the second shoulder 20 is also attached to the base 8.

As noted earlier, the guide member 6 is pivotly attached to the shoulders 14 and 20 at pivot points 26 and 28. The guide member 6 consist of the first leg 30 that extends to the slotted top portion 32 via hinge 35*a*, which in turn extends to the second leg 34 via hinge 35*b*. The first leg 30 is pivotly attached to the leg 18, and second leg 34 is pivotly attached to the leg 24. The slotted top portion 32 contains an elongated slot opening 36 that defines an area that the putter shaft may travel, and wherein the slot 36 contains enlarged openings 38 and 40. The slotted top portion 32 contains the edge guide 42 which defines the shaft line previously mentioned. The edge guide 42 is parallel with the edge 46 of the base 8.

FIG. 9 further depicts the laser alignment means, seen generally at 72, for aligning a laser beam. In the preferred embodiment of FIG. 9, the laser alignment means 72 will be attached to the training device 2 and, in particular, to the base 8. The laser alignment means 72 includes a "C" plate 74, and wherein the "C" plate 74 has a first leg 76 that extends to a second intermediate leg 78 which in turn extends to the third leg 80. The first leg 76 has an aperture 82 that will align with the aperture 84 so that the attachment means, such as a locking pin or bolt, can be disposed there through to attach the laser alignment means 72 to the base 8. It should be noted that legs 76 and 80 can be designed to fit into female receivers on the base 8 for attachment purposes. Returning to FIG. 9, the third leg 80 has aperture 86 that will align with the aperture 88, and wherein attachment means (such as a locking pin or bolt) can be placed in order to further attach the laser attachment means 72 to the base 8.

The laser alignment means 72 further contains a telescoping arm 90, and wherein the arm 90 has attached a laser housing 92. The telescoping arm 90 is slidably attached to the C plate 74. The laser housing 92 will hold the actual laser beam generator. As noted earlier, lasers are commercially available. FIG. 9 also illustrates a second, further extended position, namely the position seen at 94. The extendable arm positions allow for easy storage since the arm can be contracted, as well as customizing the distance needed for the individual golfer to position the golf ball in front of the training device 2.

FIG. 9 also depicts a second laser housing 96, and wherein the second laser housing 96 is attached to the telescoping arm 98, and wherein the telescoping arm 98 is slidably attached to the "C" plate 74. Additionally, FIG. 9 depicts a second position of the laser housing 96, namely the position seen as numeral 100. The second laser housing 96 is included for the situations where the golfer is a left handed player. It should be noted that the entire laser alignment means 72 can be placed onto the opposite end, such as the end 102 of base 8. Hence, in the case that a left-handed golfer wishes to use the training device 2, the golfer would simply attach the laser alignment means 72 on the opposite end 102.

Also depicted in FIG. 9 is the variable opening slot 36 wherein there is included a slidable sleeve 110. The plate can be adjusted to increase the width of the opening 36 or decrease the width of the opening 36 in an effort to train the golfer to utilize the technique of keeping the putter shaft parallel with the base line B, shaft line C, practice line 47, and the target line 52 (seen in FIGS. 3 and 4). Returning to FIG. 9, the width can be set by adjusting screws set out in the openings 112, 114.

Figure 11:
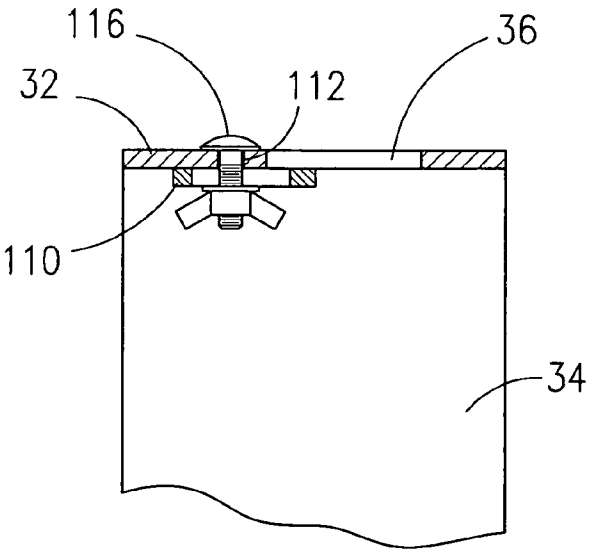
FIG. 11 is a cross-sectional view of the variable opening slot taken from line I-I of FIG. 10.
Figure 10:
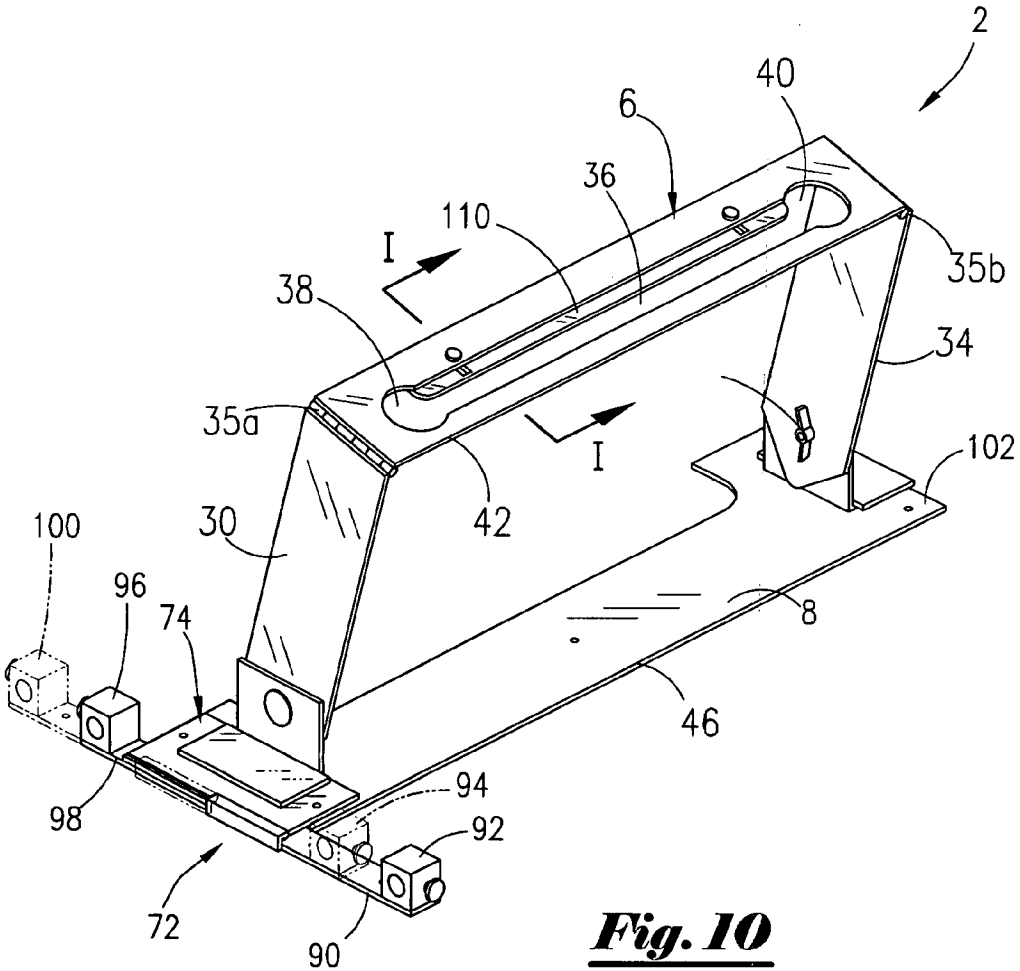
FIG. 10 is an isometric view of the second preferred embodiment seen in FIG. 9.

FIG. 10 is an assembled, isometric view of the second preferred embodiment seen in FIG. 9. Note that this embodiment includes the laser alignment means 72. Therefore, the embodiment seen in FIG. 10 is for use by a right handed player. In the event that a left-handed golfer wishes to use the training device 2, the golfer simply detaches the laser alignment means 72 from the end shown in FIG. 10 and reattaches on the opposite end 102. FIG. 11 is a cross-sectional view of the variable opening slot 36 taken from line I-I of FIG. 10. FIG. 11 depicts the sleeve 110 being held in place via attachment means 116, which is a wing nut and bolt in the preferred embodiment.

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

I claim:

1. A device for putting a golf ball comprising:
a base having an elongated side defining a base line;
a first shoulder attached to a first end of the base;
a second shoulder attached to a second end of the base;
a guide member having a first side attached to the first shoulder, a second side attached to the second shoulder, and a top surface; and,
wherein said guide member contains an elongated side defining a shaft line that is parallel with the base line of the base; and,
wherein said top surface has a slotted opening that defines a practice line that is parallel with the base line of the base and the shaft line of the guide member;
wherein said slotted opening is sized to receive a shaft of a putter, and
wherein said slotted opening contains an enlarged end section.

2. The device of claim 1 wherein the first side and the second side of the guide member is pivotly attached to the first shoulder and the second shoulder so that the guide member can be pivoted.

3. The device of claim 2 further comprising:
a laser means, operatively associated with the first end of the base, for generating a laser beam;
a target reflector for the laser beam to illuminate;
wherein said laser beam is parallel with the base line, the shaft line, and the practice line.

4. The device of claim 3 wherein said target reflector is a golf ball.

5. The device of claim 4 wherein said base is a rectangular member.

6. A teaching apparatus for putting a golf ball comprising:
a base having an elongated side defining a base line, and wherein said base has a first end and a second end;
a guide member having a first side attached to the first end of the base, a second side attached to the second end of the base, and a top surface;
a first shoulder attached to a first end of the base;
a second shoulder attached to a second end of the base;
wherein said first side of the guide member is pivotly attached to the first shoulder, and said second side of the guide member is pivotly attached to the second shoulder;
wherein said guide member contains an elongated side defining a shaft line that is parallel with the base line of the base; and,
wherein said top surface has an opening that defines a practice line that is parallel with the base line of the base and the shaft line of the guide member.

7. The apparatus of claim 6 further comprising:
a laser means, operatively associated with the first end of the base, for generating a laser beam;
a target reflector for the laser beam to illuminate;
wherein said laser beam is parallel with the base line, the shaft line, and the practice line.

8. The apparatus of claim 7 wherein said target reflector is a golf ball.

9. The apparatus of claim 8 wherein said opening is sized to receive a shaft of a putter.

10. The apparatus of claim 9 wherein said opening contains an enlarged end section.

11. The apparatus of claim 10 wherein said base is a rectangular member.

12. A device for putting a golf ball comprising:
a base having an elongated side defining a base line;
a first shoulder attached to a first end of the base;
a second shoulder attached to a second end of the base;
a guide member having a first side pivotly attached to the first shoulder, a second side pivotly attached to the second shoulder, and a top surface;
an elongated side contained on said guide member that defines a shaft line that is parallel with the base line of the base;
wherein said top surface has a slotted opening that defines a practice line that is parallel with the base line of the base and the shaft line of the guide member, and, wherein said slotted opening contains a slidable sleeve in order to vary the width of said slotted opening.

13. The device of claim 12 further comprising:

a removable laser alignment means for positioning a laser;

a laser means, operatively attached to the laser alignment means, for generating a laser beam;

a target reflector for the laser beam to illuminate;

wherein said laser beam is parallel with the base line, the shaft line and the practice line.

14. The device of claim 13 wherein said removable laser alignment means comprises:

a telescoping arm having a laser housing containing the laser means and wherein said laser housing can be telescoped from a retracted position to an extended position.

15. The device of claim 13 wherein said removable laser alignment means can be attached to either a first end of said base or a second end of said base.

16. The device of claim 12 further comprising:

a laser housing attached to said base;

laser means, configured to be received within said laser housing, for generating a laser beam;

a fork device attached to said base and configured to allow the laser beam there through.

* * * * *